US010745634B2

(12) United States Patent
Chang et al.

(10) Patent No.: US 10,745,634 B2
(45) Date of Patent: Aug. 18, 2020

(54) GAS HYDRATE INHIBITORS

(71) Applicant: The Lubrizol Corporation, Wickliffe, OH (US)

(72) Inventors: Zen-Yu Chang, Conroe, TX (US); Antonio Mastrangelo, Alfreton (GB)

( * ) Notice: Subject to any disclaimer, the term of this patent is extended or adjusted under 35 U.S.C. 154(b) by 0 days.

(21) Appl. No.: 16/307,355

(22) PCT Filed: Jun. 22, 2017

(86) PCT No.: PCT/US2017/038734
§ 371 (c)(1),
(2) Date: Dec. 5, 2018

(87) PCT Pub. No.: WO2017/223306
PCT Pub. Date: Dec. 28, 2017

(65) Prior Publication Data

US 2019/0136146 A1 May 9, 2019

Related U.S. Application Data

(60) Provisional application No. 62/353,174, filed on Jun. 22, 2016.

(51) Int. Cl.
*C10L 3/10* (2006.01)

(52) U.S. Cl.
CPC ..... *C10L 3/107* (2013.01); *C10L 2200/0259* (2013.01); *C10L 2230/14* (2013.01)

(58) Field of Classification Search
CPC ..... C10L 3/107; C10L 2200/0259; C10L 2230/14
USPC ..... 585/15; 507/927, 933, 934
See application file for complete search history.

(56) References Cited

U.S. PATENT DOCUMENTS

| | | | | |
|---|---|---|---|---|
| 7,341,617 | B2 | 3/2008 | Dahlmann et al. | |
| 2004/0163306 | A1 | 8/2004 | Dahlmann | |
| 2004/0167040 | A1* | 8/2004 | Dahlmann | C07D 207/412 508/244 |
| 2005/0101495 | A1 | 5/2005 | Dahlmann | |
| 2014/0107002 | A1 | 4/2014 | Jones et al. | |
| 2016/0230077 | A1* | 8/2016 | Mastrangelo | C09K 8/524 |

FOREIGN PATENT DOCUMENTS

| | | | |
|---|---|---|---|
| WO | 2015183908 | A1 | 12/2015 |

* cited by examiner

*Primary Examiner* — Thuan D Dang
(74) *Attorney, Agent, or Firm* — Vincent Cortese; Christopher DeMas; Teresan Gilbert

(57) ABSTRACT

The technology described herein relates to anti-agglomerants suitable for use in preventing, inhibiting, or otherwise modifying the agglomeration of gas hydrates in crude hydrocarbon streams. The technology relates to anti-agglomerant additives, additive formulations, compositions containing such anti-agglomerant additives and additive formulations, and methods and processes of using such anti-agglomerant additives and additive formulations in preventing, inhibiting, or otherwise modifying agglomeration of gas hydrates.

22 Claims, No Drawings

GAS HYDRATE INHIBITORS

The technology described herein relates to anti-agglomerants suitable for use in preventing, inhibiting, or otherwise modifying the agglomeration of gas hydrates in crude hydrocarbon streams. The technology relates to anti-agglomerant additives, additive formulations, compositions containing such anti-agglomerant additives and additive formulations, and methods and processes of using such anti-agglomerant additives and additive formulations in preventing, inhibiting, or otherwise modifying agglomeration of gas hydrates.

BACKGROUND OF THE INVENTION

Low molecular weight hydrocarbons such as methane, ethane, propane, n-butane, and isobutane are often found in natural gas streams, and may also be present in crude petroleum streams. Water is also very often present in these streams, as water is typically present in petroleum-bearing formations. Under conditions of elevated pressure and reduced temperature, including those often seen in petroleum-bearing formations and in the processes used to recover such materials, mixtures of water and many of the described hydrocarbons, sometimes referred to as lower hydrocarbons, or other hydrate forming compounds tend to form hydrocarbon hydrates. These hydrates are sometimes referred to as clathrates. These hydrates are generally crystalline in structure where water has formed a cage-like structure around a lower hydrocarbon or other hydrate forming compound molecule. For example, at a pressure of about 1 MPa, ethane can form gas hydrates with water at temperatures below 4 degrees Celsius. At a pressure of 3 MPa, it can form gas hydrates with water at temperatures below 14 degrees Celsius. Temperatures and pressures such as these are commonly encountered in the environments seen and equipment used where natural gas and crude petroleum are produced and transported, including but not limited to pipelines. The formed hydrates can then agglomerate and cause blockages in the pipelines. A notable example would be pipelines used on the seabed. Such crude petroleum pipelines exposed to conditions on the seabed and succumbing to gas hydrate formation precipitated the oil leak accident in the Gulf of Mexico.

The formation and agglomeration of gas hydrates are of particular concern in pipelines, as they may contribute to and even cause pipeline blockages during the production and transport of natural gas or crude petroleum streams. As gas hydrates form and inside a pipe or similar equipment, they can block or damage the pipeline and associated valves and other equipment, leading to costly repairs and down time. To prevent such plugging, physical means have been used, such as removal of free water, and maintaining elevated temperatures and/or reduced pressures, but these can be impractical to implement, and otherwise undesirable because of loss of efficiency and production. Chemical treatments have also been utilized, but also have their limitations. Thermodynamic hydrate inhibitors such as lower molecular weight alcohols and glycols are required in large amounts, and attempts to recover and recycle these inhibitors can lead to other issues, such as scale formation. Other groups of low dosage hydrate inhibitors are also known. One group of low dosage hydrate inhibitors are known as kinetic inhibitors. Kinetic inhibitors have a major limitation in relation to the conditions where sub-cooling is high. For example, when the temperature reaches more than about 12° F. lower than the bubble point temperature of the gas hydrate, the low dosage kinetic inhibitors may not be effective. Thus there is a continued need for additives that allow the prevention and/or inhibition of gas hydrate agglomeration, in order to minimize unscheduled shutdowns, maintenance and repair, and to provide safer operation of production and/or transport facilities that utilize natural gas or crude petroleum streams.

SUMMARY OF THE INVENTION

It has been found that reaction products of 1) a dicarboxylic acid, with 2) a nitrogen containing compound, and 3) a quaternizing agent, as well as reaction products of hydrocarbyl substituted dicarboxylic acids and the nitrogen containing compounds and a quaternizing agent are effective anti-agglomerant additives for inhibiting the agglomeration of gas hydrates in crude hydrocarbon streams.

Accordingly, provided are anti-agglomerant additive formulations comprising an anti-agglomerant. The anti-agglomerant can be the reaction product of: (i) a dicarboxylic acid reactant, (ii) a nitrogen containing compound having an oxygen or nitrogen atom capable of condensing with said dicarboxylic acid reactant, and further having at least one quaternizeable amino group, and (iii) a quaternizing agent suitable for converting the quaternizeable amino group of the nitrogen containing compound to a quaternary nitrogen.

In an embodiment, the dicarboxylic acid reactant of the anti-agglomerant can optionally be substituted with a hydrocarbyl substituent. In a further embodiment, the hydrocarbyl substituted dicarboxylic acid reactant can be a polyisobutylene succinic anhydride. In another embodiment, the hydrocarbyl substituted dicarboxylic acid reactant can be a $C_1$ to $C_{22}$ alkane or olefin substituted succinic anhydride.

In embodiments, the nitrogen containing compound of the anti-agglomerant can be a diamine, such as, for example, an N,N-dialkyl-alkylene diamine, for example, N,N-dimethyl-ethylene diamine. In another embodiment, the nitrogen containing compound can be an alkanolamine, such as, for example, an N,N-dialkyl-alkanol amine, for example, N,N-dimethyl-ethanol amine.

The anti-agglomerant can be an amide, imide, or ester.

In some embodiments, the quaternizing agent may include sulphonates; sultones; phosphates; borates; nitrites; nitrates; oxalates; alkanoates; dithiophosphates; sulfates; halides; carbonates; hydrocarbyl epoxides; carboxylates; esters; and mixtures thereof. In some embodiments, the quaternizing agent may be a sulfate, such as dimethyl sulfate. In some embodiments, the quaternizing agent may be a halide, such as HCl. The quaternizing agent can also be a carbonate. In some embodiments, the quaternizing agent may be an epoxide, such as a hydrocarbyl epoxide, such as, for example, ethylene oxide, propylene oxide, butylene oxide, and the like.

The quaternizing agent may be optionally employed with an acid, such as a carboxylic acid, such as, for example, acetic acid, glycolic acid, butanoic acid, salicylic acid, and the like, or mixtures thereof. For example, the quaternizing salt may be prepared with an epoxide quaternizing agent in combination with an acid.

In an embodiment, the anti-agglomerant additive further comprises a hydrocarbyl amido hydrocarbyl amine.

Also provided are compositions containing the anti-agglomerant and a crude hydrocarbon stream. Such compositions may additionally include water, and/or one or more lower hydrocarbons or other hydrate forming compounds. In embodiments, a portion of the water and at least a portion of the one or more lower hydrocarbons or other hydrate forming compound can be in the form of one or more hydrates.

In an embodiment, the crude hydrocarbon stream can be a stream from a methane well, a natural gas well, or a petroleum well.

In further embodiments, the crude hydrocarbon stream can include one or more other hydrate forming compounds comprising carbon dioxide, hydrogen sulfide, or a combination thereof.

Also provided are methods of preventing agglomeration of hydrates by contacting a crude hydrocarbon stream with at least one anti-agglomerant as described herein.

DETAILED DESCRIPTION OF THE INVENTION

Various preferred features and embodiments will be described below by way of non-limiting illustration.

There is provided anti-agglomerants for use in preventing agglomeration of hydrates in a crude hydrocarbon stream.

In one aspect, there is provided an anti-agglomerant that can be the reaction product of a (i) a dicarboxylic acid reactant, and (ii) a nitrogen containing compound having an oxygen or nitrogen atom capable of condensing with said hydrocarbyl substituted dicarboxylic acid reactant. In a further aspect, the anti-agglomerant can be the reaction product of a (i) a dicarboxylic acid reactant, and (ii) a nitrogen containing compound having an oxygen or nitrogen atom capable of condensing with said hydrocarbyl substituted dicarboxylic acid reactant, and further having at least one quaternizeable amino group, and (iii) a quaternizing agent suitable for converting the quaternizeable amino group of the nitrogen containing compound to a quaternary nitrogen.

The Dicarboxylic Acid Reactant

The dicarboxylic acid in the anti-agglomerant can be a monounsaturated carboxylic acid reactant such as (i) α,β-monounsaturated $C_4$ to $C_{10}$ dicarboxylic acids such as fumaric acid, itaconic acid, and maleic acid; or (ii) derivatives of (i) such as anhydrides or $C_1$ to $C_5$ alcohol derived mono- or di-esters of (i).

Optional Hydrocarbyl Substituent

In some embodiments, the dicarboxylic acid reactant can be substituted with an optional hydrocarbyl substituent.

In an embodiment, the dicarboxylic acid can be substituted by reacting the dicarboxylic reactant with a hydrocarbyl substituent, such as, for example, an alkane or an olefin.

In an embodiment, the hydrocarbyl substituent can be a lower alkane or olefin group. By "lower alkane or olefin" it is meant an alkane or olefin containing on average from about 1 to about 22 carbon atoms; from about 4 to about 20 carbon atoms, from about 6 or 9 to about 18 carbon atoms, or from about 12 to about 18 carbon atoms. The lower alkane or olefin group can be saturated, unsaturated, branched, linear or mixtures thereof. Typical examples of lower alkane or olefin groups can include, for example, methane, butane or butene, hexane or hexene, nonane or nonene, dodecane or dodecene, octadecane or octadecene, eicosane or eicosene, docosane or docosene, and branched derivatives and isomers thereof.

In an embodiment, the hydrocarbyl substituted dicarboxylic acid can be the reaction product of a branched or linear lower alkane or olefin and maleic anhydride. This reaction is well known to those skilled in the art. In an embodiment, the hydrocarbyl substituted dicarboxylic acid can be a $C_1$ to $C_{22}$ alkane or olefin substituted succinic anhydride.

In an embodiment, the hydrocarbyl-substituent can be a polyolefin. In one embodiment, the polyolefin can have a number average molecular weight ("Mn") of from about 100 or 300 to about 5000, or from about 500 to about 2500. The Mn of the polyolefin can also be from about 1300 to about 3000. The Mn of the polyolefin substituent can also be from about 1500 to about 2800 or 2900, or from about 1700 to about 2700, or from about 1900 to about 2600, or about 2000 to about 2500. In an embodiment, the Mn of the polyolefin can be from about 100 to about 750. The Mn of the polyolefin substituent can also be from about 300 or 350 to about 700, and in some cases from about 400 to about 600 or 650. In an embodiment, the polyolefin substituent can be any compound containing an olefinic bond represented by the general formula:

$$(R^1)(R^2)C{=}C(R^3)(CH(R^4)(R^5)) \quad \text{(I)}$$

wherein each of $R^1$ and $R^2$ is, independently, hydrogen or a hydrocarbon based group. Each of $R^3$, $R^4$ and $R^5$ is, independently, hydrogen or a hydrocarbon based group; preferably at least one is a hydrocarbon based group containing at least 20 carbon atoms.

Olefin polymers for reaction with the monounsaturated carboxylic acids can include polymers comprising a major molar amount of $C_2$ to $C_{20}$, e.g. $C_2$ to $C_5$ monoolefin. Such olefins include ethylene, propylene, butylene, isobutylene, pentene, octene-1, or styrene. The polymers can be homopolymers such as polyisobutylene, as well as copolymers of two or more of such olefins such as copolymers of; ethylene and propylene; butylene and isobutylene; propylene and isobutylene. Other copolymers include those in which a minor molar amount of the copolymer monomers e.g., 1 to 10 mole % is a $C_4$ to $C_{18}$ diolefin, e.g., a copolymer of isobutylene and butadiene; or a copolymer of ethylene, propylene and 1,4-hexadiene.

In one embodiment, at least one R of formula (I) is derived from polybutene, that is, polymers of $C_4$ olefins, including 1-butene, 2-butene and isobutylene. $C_4$ polymers can include polyisobutylene. In another embodiment, at least one R of formula (I) is derived from ethylene-alpha olefin polymers, including ethylene-propylene-diene polymers. Ethylene-alpha olefin copolymers and ethylene-lower olefin-diene terpolymers are described in numerous patent documents, including European patent publication EP 0 279 863 and the following U.S. Pat. Nos. 3,598,738; 4,026,809; 4,032,700; 4,137,185; 4,156,061; 4,320,019; 4,357,250; 4,658,078; 4,668,834; 4,937,299; 5,324,800 each of which are incorporated herein by reference for relevant disclosures of these ethylene based polymers.

In another embodiment, the olefinic bonds of formula (I) are predominantly vinylidene groups, represented by the following formulas:

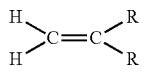

(II)

wherein R is a hydrocarbyl group

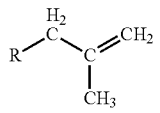

(III)

wherein R is a hydrocarbyl group.

In one embodiment, the vinylidene content of formula (I) can comprise at least about 30 mole % vinylidene groups, at least about 50 mole % vinylidene groups, or at least about 70 mole % vinylidene groups. Such material and methods for preparing them are described in U.S. Pat. Nos. 5,071,919; 5,137,978; 5,137,980; 5,286,823, 5,408,018, 6,562,913, 6,683,138, 7,037,999 and U.S. Publication Nos. 20040176552A1, 20050137363 and 20060079652A1, which are expressly incorporated herein by reference, such products are commercially available by BASF, under the tradename GLISSOPAL® and by Texas PetroChemical LP, under the tradename TPC 1105™ and TPC 595™.

Methods of making hydrocarbyl substituted carboxylic acids from the reaction of a monounsaturated carboxylic acid reactant and the compound of formula (I) are well known in the art and disclosed in the following patents: U.S. Pat. Nos. 3,361,673 and 3,401,118 to cause a thermal "ene" reaction to take place; U.S. Pat. Nos. 3,087,436; 3,172,892; 3,272,746, 3,215,707; 3,231,587; 3,912,764; 4,110,349; 4,234,435; 6,077,909; 6,165,235 and are hereby incorporated by reference.

In another embodiment, the hydrocarbyl substituted dicarboxylic acid can be the reaction product of a polyolefin, such as, for example, a 100 to 5000 Mn polyisobutylene and maleic anhydride. This reaction is well known to those skilled in the art. In an embodiment, the hydrocarbyl substituted dicarboxylic acid can be polyisobutylene succinic anhydride.

Nitrogen Containing Compound

The composition of the present invention contains a nitrogen containing compound having an oxygen or nitrogen atom capable of reacting with the dicarboxylic acid.

In one embodiment, the nitrogen containing compound can be represented by the following formulas:

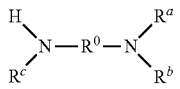

(IV)

wherein $R^O$ is a saturated or unsaturated, linear, branched, cyclic or acyclic alkylene or aromatic group containing about 1 to about 12 or about 1 to about 6 carbon atoms; and $R^a$, $R^b$, and $R^c$, are independently hydrogen or a $C_1$-$C_{12}$ or $C_1$-$C_6$ saturated or unsaturated, linear, branched, cyclic or acyclic alkylene group

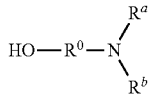

(V)

wherein $R^O$ is a saturated or unsaturated, linear, branched, cyclic or acyclic alkylene or aromatic group containing about 1 to about 12 or about 1 to about 6 carbon atoms and $R^a$ and $R^b$ are independently hydrogen or a $C_1$-$C_{12}$ or $C_1$-$C_6$ saturated or unsaturated, linear, branched, cyclic or acyclic alkylene group.

Examples of the nitrogen containing compound capable of reacting with the dicarboxylic acid reactant can include diamines and alkanolamines.

Diamines can include, but are not limited to, N,N-dialkyl-alkylene diamine, such as, for example, N,N-dimethyl-aminopropylamine, N,N-diethyl-aminopropylamine, N,N-dimethyl-aminoethylamine. Other diamines can include, for example, dimethyl aminopropylamine, ethylenediamine, 1,2-propylenediamine, 1,3-propylene diamine, the isomeric butylenediamines, pentanediamines, hexanedi amines, heptanediamines, diethylenetriamine, dipropylenetriamine, dibutylenetri amine, triethylenetetraamine, tetraethyl enepentaamine, pentaethyl enehexaamine, hexamethylenetetramine, and bis(hexamethylene) triamine, the diaminobenzenes, the diaminopyridines or mixtures thereof.

Alkanolamines can be amino alcohols, such as, an ethanolamine (including mono, di and tri ethanolamines), or a propanol amines (including mono, di and tri propanolamines) in which nitrogen is attached directly to the carbon of the alkyl alcohol. Examples of the alkanolamine component of the acylated nitrogen compounds can include, for example, N,N-dialkyl-alkanol amine, such as, for example, N,N-dimethylaminopropanol, N,N-diethylaminopropanol, N,N-diethyl aminobutanol, N,N,N-tris(hydroxyethyl)amine, N,N,N-tris(hydroxymethyl)amine, N—N-dimethylethanolamine, N—N-diethylethanolamine. Further alkanol amines can include, for example, monoethanolamine, triethanolamine, trimethanolamine, methylethanolamine, methyldiethanolamine, dimethylethanolamine, diethyl ethanolamine, dibutyl ethanolamine, monoisopropanolamine, diisopropanolamine, triisopropanolamine. Further examples of alkanolamines suitable for reacting with the dicarboxylic reactant can include, for example, 2-(diisopropylamino) ethanol, 2-(dibutylamino)ethanol, 3-dimethylamino-1-propanol, 3-diethyl amino-1-propanol, 1-dimethylamino-2-propanol, 1-diethylamino-2-propanol, 2-dimethylamino-2-methyl-1-1propanol, 5-dimethylamino-2-propanol, 2-[2-(dimethylamino)ethoxy]-ethanol, 4-methyl-2-{piperidino methyl}phenol, 1-benzyl-3-pyrrolidinol, 1-benzylpyrrolidine-2-methanol, 2,4,6-tri(dimethylaminomethyl)phenol, dialkoxylated amines such as Ethermeen T12.

Additional nitrogen containing compounds capable of reacting with the dicarboxylic acid reactant can further include aminoalkyl substituted heterocyclic compounds such as 1-(3-aminopropyl)imidazole and 4-(3-aminopropyl) morpholine, 1-(2-aminoethyl)piperidine, 3,3-diamino-N-methyldipropylamine, 3'3-aminobis(N,N-dimethylpropylamine).

In one embodiment, the nitrogen containing compound can be an imidazole, for example, as represented by the following formula:

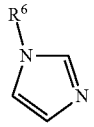

imidazole (VI)

wherein $R^6$ is an amine or alkanol capable of condensing with said dicarboxylic acid reactant and having from 3 to 8 carbon atoms In one embodiment, the nitrogen containing compound can be represented by at least one of formulas VII or VIII:

(VII)

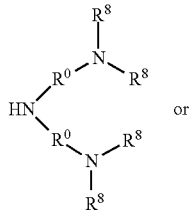

or (VIII)

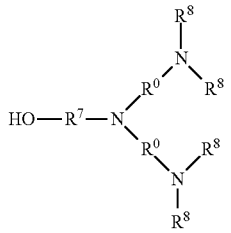

wherein each $R^0$ can be, individually, a C1 to C6 hydrocarbyl group, $R^7$ is a C1 to C6 alkyl group, and each $R^8$ can be, individually, a hydrogen or a C1 to C6 hydrocarbyl group. In one embodiment, $R^0$ can be, for example, a C1, C2 or C3 alkyl group. In some embodiments, $R^7$ can be, for example, a C1, C2 or C3 alkyl group. In the same or different embodiments, each $R^8$ can be, for example, H or a C1, C2 or C3 alkyl group.

The reaction products of the dicarboxylic acid reactant and nitrogen containing compound can include amides, imides, esters, amine salts, ester-amides, ester-amine salts, amide-amine salts, acid-amides, acid-esters and mixtures thereof. The reaction and the resulting products of the dicarboxylic acid reactant and the nitrogen containing compound are readily known to those skilled in the art.

In embodiments, the reaction between the dicarboxylic acid reactant and nitrogen containing compounds can be carried out at temperatures of greater than about 80° C., or 90° C., or in some cases 100° C., such as between about 100 and about 150 or 200° C., or about 125 and about 175° C. At the foregoing temperatures water may be produced during the condensation, which is referred to herein as the water of reaction. In some embodiments, the water of reaction can be removed during the reaction, such that the water of reaction does not return to the reaction and further react.

In embodiments, the reaction between the dicarboxylic acid reactant and nitrogen containing compounds can be carried out at temperatures of less than about 80° C., such as between about 30 and about 70 or 75° C., or about 40 and about 60° C.

The dicarboxylic acid reactant and nitrogen containing compounds may be reacted at a ratio of 1:1, but the reaction may also containing the respective reactants (i.e., dicarboxylic acid reactant:nitrogen containing compound) from about 3:1 to about 1:1.2, or from about 2.5:1 to about 1:1.1, and in some embodiments from about 2:1 to about 1:1.05.

Optional Salts of the Reaction Product

In a further embodiment, the reaction product of the dicarboxylic acid reactant and the nitrogen containing compound may be further reacted to form a salt.

In one embodiment, the amine of the reaction product may be further reacted with an acid to form a salt. Acids suitable to form salts with the amine in the reaction product can include, but not be limited to, mineral acids, such as for example, halogen containing acids, including for example, hydrochloric acid, boric acid, hydrofluoric acid, hydrobromic acid, perchloric acid, hydroiodic acid and the like. Other mineral acids can include, for example, nitric acid, sulfuric acid or sulfonic acids, and phosphoric or phosphonic acids. The acid can also be an organic acid, such as a carboxylic acids, such as, for example, acetic acid. The method of forming salts is well known in the art. In a further embodiment, the reaction product of the dicarboxylic acid reactant and the nitrogen containing compound may be further reacted to form a quaternary salt, in which case the nitrogen containing compound includes a quaternizable amino group. A quaternizable amino group is any primary, secondary or tertiary amino group on the nitrogen containing compound that is available to react with a quaternizing agent to become a quaternary amino group. The nitrogen containing compounds disclosed above include quaternizeable amino groups.

The dicarboxylic acid reactant and a nitrogen containing compound having a quaternizeable amino group can be reacted together to form a quaternizeable compound that may be further reacted with a quaternizing agent to form a quaternary ammonium salt.

The quaternary ammonium salt can be formed when the quaternizeable compound, that is, the reaction products of the dicarboxylic acid reactant and nitrogen containing compounds described above, are reacted with a quaternizing agent. Suitable quaternizing agents can include, for example, sulphonates; sultones; phosphates; borates; nitrites; nitrates; oxalates; alkanoates; dithiophosphates; sulfates; halides; carbonates; hydrocarbyl epoxides; carboxylates; esters; and mixtures thereof.

In one embodiment, the quaternizing agent can include alkyl halides, such as chlorides, iodides or bromides; alkyl sulphonates; dialkyl sulphates, such as, dimethyl sulphate and diethyl sulphate; sultones; alkyl phosphates; such as, C1-12 trialkylphosphates; di C1-12 alkylphosphates; borates; C1-12 alkyl borates; alkyl nitrites; alkyl nitrates; dialkyl carbonates, such as dimethyl oxalate; alkyl alkanoates, such as methylsalicylate; O,O-di-C1-12 alkyldithiophosphates; or mixtures thereof.

In one embodiment, the quaternizing agent may be derived from dialkyl sulphates such as dimethyl sulphate or diethyl sulphate, N-oxides, sultones such as propane and butane sultone; alkyl, acyl or aryl halides such as methyl and ethyl chloride, bromide or iodide or benzyl chloride, and a hydrocarbyl (or alkyl) substituted carbonates. If the alkyl halide is benzyl chloride, the aromatic ring is optionally further substituted with alkyl or alkenyl groups.

The hydrocarbyl (or alkyl) groups of the hydrocarbyl substituted carbonates may contain 1 to 50, 1 to 20, 1 to 10 or 1 to 5 carbon atoms per group. In one embodiment, the hydrocarbyl substituted carbonates contain two hydrocarbyl groups that may be the same or different. Examples of suitable hydrocarbyl substituted carbonates include dimethyl or diethyl carbonate.

In another embodiment, the quaternizing agent can be a hydrocarbyl epoxide, for example, as represented by the following formula:

(IX)

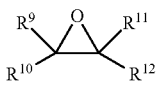

wherein $R^9$, $R^{10}$, $R^{11}$ and $R^{12}$ can be independently H or a hydrocarbyl group contain from 1 to 50 carbon atoms. Examples of hydrocarbyl epoxides include: ethylene oxide, propylene oxide, butylene oxide, styrene oxide and combinations thereof. In some embodiments, the hydrocarbyl epoxide can be an alcohol functionalized epoxide, C4 to C14 epoxides, and mixtures thereof. In one embodiment, the quaternizing agent is a hydrocarbyl epoxide quaternizing agent. In one embodiment, the hydrocarbyl epoxide quaternizing agent is propylene oxide. In one embodiment, the hydrocarbyl epoxide quaternizing agent is styrene oxide.

Exemplary C4 to C14 epoxides are those of formula IX where $R^9$, $R^{10}$, $R^{11}$ and $R^{12}$ can be independently H or a C2 to C12 hydrocarbyl group. In an embodiment, the epoxides can be C4 to C14 epoxides. Epoxides suitable as quaternizing agents in the present technology can include, for example, C4 to C14 epoxides having linear hydrocarbyl substituents, such as, for example, 2-ethyloxirane, 2-propyloxirane, and the like, and C4 to C14 epoxides having branched and cyclic or aromatic substituents, such as, for example, styrene oxide. C4 to C14 epoxides can also include epoxidized tri-glycerides, fats or oils; epoxidized alkyl esters of fatty acids; and mixtures thereof.

Exemplary alcohol functionalized epoxides can include those of formula IX where $R^9$, $R^{10}$, $R^{11}$ and $R^{12}$ can be independently H or a hydroxyl containing hydrocarbyl group. In an embodiment, hydroxyl containing hydrocarbyl group can contain from 2 to 32, or from 3 to 28, or even from 3 to 24 carbon atoms. Exemplary alcohol functionalized epoxide derivatives can include for example, glycidol and the like.

In some embodiments the hydrocarbyl epoxide can be employed in combination with an acid. The acid used with the hydrocarbyl epoxide may be a separate component, such as a carboxylic acid. Any carboxylic acid may be suitable as the additional acid, with some examples including acetic acid, glycolic acid, butanoic acid, salicylic acid, propionic acid, 2-ethylhexanoic acid, and the like. Mixtures of carboxylic acids, including the foregoing carboxylic acids, may also be employed with the epoxide quaternizing agent. In an embodiment, the quaternizing agent is a hydrocarbyl epoxide in combination with an acid, such as, for example, acetic acid.

In other embodiments, a small amount of an acid component may be present, but at <0.2 or even <0.1 moles of acid per mole of quaternizeable compound. These acids may also be used with the other quaternizing agents described above, including the hydrocarbyl substituted carbonates and related materials described below.

In some embodiments the quaternizing agent does not contain any substituent group that contains more than 20 carbon atoms.

In another embodiment the quaternizing agent can be an ester of a carboxylic acid capable of reacting with a tertiary amine to form a quaternary ammonium salt, or an ester of a polycarboxylic acid. In a general sense such materials may be described as compounds having the structure:

$$R^{13}—C(=O)—O—R^{14} \quad (X)$$

where $R^{13}$ is an optionally substituted alkyl, alkenyl, aryl or alkylaryl group and $R^{14}$ is a hydrocarbyl group containing from 1 to 22 carbon atoms.

Suitable compounds include esters of carboxylic acids having a pKa of 3.5 or less. In some embodiments the compound is an ester of a carboxylic acid selected from a substituted aromatic carboxylic acid, an α-hydroxycarboxylic acid and a polycarboxylic acid. In some embodiments the compound is an ester of a substituted aromatic carboxylic acid and thus $R^{13}$ is a substituted aryl group. $R^{13}$ may be a substituted aryl group having 6 to 10 carbon atoms, a phenyl group, or a naphthyl group. $R^3$ may be suitably substituted with one or more groups selected from carboalkoxy, nitro, cyano, hydroxy, SR' or NR'R" where each of R' and R" may independently be hydrogen, or an optionally substituted alkyl, alkenyl, aryl or carboalkoxy groups. In some embodiments R' and R" are each independently hydrogen or an optionally substituted alkyl group containing from 1 to 22, 1 to 16, 1 to 10, or even 1 to 4 carbon atoms.

In some embodiments $R^{13}$ in the formula above is an aryl group substituted with one or more groups selected from hydroxyl, carboalkoxy, nitro, cyano and $NH^2$. $R^{13}$ may be a poly-substituted aryl group, for example trihydroxyphenyl, but may also be a mono-substituted aryl group, for example an ortho substituted aryl group. $R^{13}$ may be substituted with a group selected from OH, $NH_2$, $NO_2$, or COOMe. Suitably $R^{13}$ is a hydroxy substituted aryl group. In some embodiments $R^{13}$ is a 2-hydroxyphenyl group. $R^{14}$ may be an alkyl or alkylaryl group, for example an alkyl or alkylaryl group containing from 1 to 16 carbon atoms, or from 1 to 10, or 1 to 8 carbon atoms. $R^{14}$ may be methyl, ethyl, propyl, butyl, pentyl, benzyl or an isomer thereof. In some embodiments $R^{14}$ is benzyl or methyl. In some embodiments the quaternizing agent is methyl salicylate. In some embodiments the quaternizing agent excludes methyl salicylate.

In some embodiments the quaternizing agent is an ester of an alpha-hydroxycarboxylic acid. Compounds of this type suitable for use herein are described in EP 1254889. Examples of suitable compounds which contain the residue of an alpha-hydroxycarboxylic acid include (i) methyl-, ethyl-, propyl-, butyl-, pentyl-, hexyl-, benzyl-, phenyl-, and allyl esters of 2-hydroxyisobutyric acid; (ii) methyl-, ethyl-, propyl-, butyl-, pentyl-, hexyl-, benzyl-, phenyl-, and allyl esters of 2-hydroxy-2-methylbutyric acid; (iii) methyl-, ethyl-, propyl-, butyl-, pentyl-, hexyl-, benzyl-, phenyl-, and allyl esters of 2-hydroxy-2-ethylbutyric acid; (iv) methyl-, ethyl-, propyl-, butyl-, pentyl-, hexyl-, benzyl-, phenyl-, and allyl esters of lactic acid; and (v) methyl-, ethyl-, propyl-, butyl-, pentyl-, hexyl-, allyl-, benzyl-, and phenyl esters of glycolic acid. In some embodiments the quaternizing agent comprises methyl 2-hydroxyisobutyrate.

In some embodiments the quaternizing agent comprises an ester of a polycarboxylic acid. In this definition we mean to include dicarboxylic acids and carboxylic acids having more than 2 acidic moieties. In some embodiments the esters are alkyl esters with alkyl groups that contain from 1 to 4 carbon atoms. Suitable example include diesters of oxalic acid, diesters of phthalic acid, diesters of maleic acid, diesters of malonic acid or diesters or triesters of citric acid.

In some embodiments the quaternizing agent is an ester of a carboxylic acid having a pKa of less than 3.5. In such embodiments in which the compound includes more than one acid group, we mean to refer to the first dissociation constant. The quaternizing agent may be selected from an ester of a carboxylic acid selected from one or more of oxalic acid, phthalic acid, salicylic acid, maleic acid, malonic acid, citric acid, nitrobenzoic acid, aminobenzoic acid and 2, 4, 6-trihydroxybenzoic acid. In some embodiments the quaternizing agent includes dimethyl oxalate, a terephthalate, such as dimethyl terephthalate, and methyl 2-nitrobenzoate.

Quaternizing agents capable of coupling more than one quaternizeable compound also may be employed. By "coupling" more than one quaternizeable compounds, it is meant that at least two quaternizeable compounds react with the same quaternizing agent to form a compound of the at least two quaternizeable compounds linked by the quaternizing agent. Such quaternizing agents may, in some instances, also be referred to as coupling quaternizing agents herein and can include, for example, polyepoxides, such as, for example, di-, tri-, or higher epoxides; polyhalides; epoxy-halides, aromatic polyesters, and mixtures thereof.

In one embodiment, the quaternizing agent can be a polyepoxide. Polyepoxides can include, for example, polyglycidyls which can include, for example, di-epoxyoctane; ethylene glycol diglycidyl ether; neopentyl glycol digycidyl ether; 1,4-butanediol diglycidyl ether; 3(bis(glycidyl oxymethyl)-methoxy)-1,2-propanediol; 1,4-cyclohexane dimethanol digylicidyl ether; diepoxycyclo-octane, bisphenol A diglycidyl ether 4-vinyl-1-cyclohexene diepoxide; N,N-Diglycidyl-4-4glycidyloxyaniline; 1,6-hexane diglycidyl ether; trimethylolpropanetriglycidyl ether; polypropyleneglycol diglycidyl ether; polyepoxidized tri-glycerides, fats or oils; and mixtures thereof.

In one embodiment, the quaternizing agent may be derived from polyhalides, such as, for example, chlorides, iodides or bromides. Such polyhalides can include, but not be limited to, 1,5-dibromopentane; 1,4-diiodobutane; 1,5-dichloropentane; 1,12-dichlorododecane; 1,12-dibromododecane; 1,2-diiodoethane; 1,2-dibromoethane; and mixtures thereof.

In an embodiment, the quaternizing agent can be an epoxy-halide, such as, for example, epichlorohydrin and the like.

The quaternizing agent may also be a poly aromatic ester. Examples of poly aromatic esters can include, but not be limited to, 4,4'-oxybis(methylbenzoate); dimethylterephthalate; and mixtures thereof.

In certain embodiments the molar ratio of the quaternizeable compound to quaternizing agent is 1:0.1 to 2, or 1:1 to 1.5, or 1:1 to 1.3. In some embodiments, particularly when employing a coupling quaternizing agent, the ratio of the quaternizeable compound to the quaternizing agent can be from about 2:1 to about 1:1.

Any of the quaternizing agents described above, including the hydrocarbyl epoxides, may be used in combination with an acid as described above.

In some embodiments, the quaternizing agent can be employed in the presence of a protic solvent, such as, for example, 2-ethylhexanol, water, and combinations thereof. In some embodiments, the quaternizing agent can be employed in the presence of an acid. In some embodiments, the acid can be an acid component in addition to the acid group present in the structure of the quaternizeable compound. In further embodiments the reaction can be free of, or essentially free of, any additional acid component other than the acid group present in the structure of the quaternizeable compound. By "free of" it is meant completely free, and by "essentially free" it is meant an amount that does not materially affect the essential or basic and novel characteristics of the composition, such as, for example, less than 1% by weight.

Structure

While the process to prepare the quaternary compound of the dicarboxylic acid and nitrogen containing compound reaction product can produce a mixture that is not readily definable apart from the process steps, certain structural components may be expected in some circumstances.

In some embodiments the quaternary compound can comprise, consist essentially of, or consist of a quaternary amide represented by the following formula:

(XI)

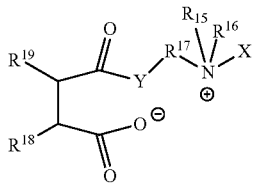

wherein: $R^{15}$ and $R^{16}$ are, independently, alkyl groups containing from 1 to 18 carbon atoms, or 2 to 16 carbon atoms, or even 3 to 14 carbon atoms; $R^{17}$ is a hydrocarbyl group containing from 1 to 12 carbon atoms and up to 3 nitrogen atoms; $R^{18}$ is H, an alkyl or olefin group of 1 to 22 carbon atoms, or 2 to 20 carbon atoms, or 3 to 18 carbon atoms, or a hydrocarbyl group having a number average molecular weight of from about 100 to about 1000, or from about 150 to about 900, or about 200 to about 800, or even from about 250 or about 300 to about 750; $R^{19}$ is H, an alkyl or olefin group of 1 to 22 carbon atoms, or 2 to 20 carbon atoms, or 3 to 18 carbon atoms, or a hydrocarbyl group having a number average molecular weight of from about 100 to about 1000, or from about 150 to about 900, or about 200 to about 800, or even from about 250 or about 300 to about 750; X is H or a group derived from a quaternizing agent; and Y is O or $NR^{28}$, where $R^{28}$ is H or a hydrocarbyl group of 1 to 18 carbon atoms, or from 1 to 14 carbons atoms, or 1 to 10 carbon atoms, or even 1 to 6 carbon atoms. $R^{28}$ can include up to 2 nitrogen atoms.

In some embodiments the reaction product can comprise, consist essentially of, or consist of an amide or ester of formula:

(XI')

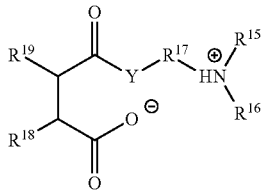

In some embodiments, X in formula (XI) can be of formula (x'):

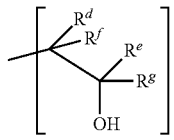

such as would be derived from a hydrocarbyl epoxide agent; where $R^d$, $R^e$, $R^f$, and $R^g$ separately can be H or a $C_1$ to $C_4$, or a $C_1$, $C_2$ or $C_3$ alkyl group. With X as formula x', formula (XI) would include:

(XI″)

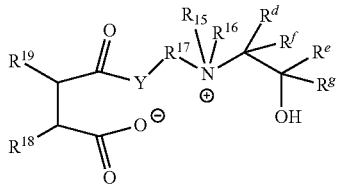

In some embodiments the quaternary compound can comprise, consist essentially of, or consist of a quaternary amide or ester of formula:

(XII)

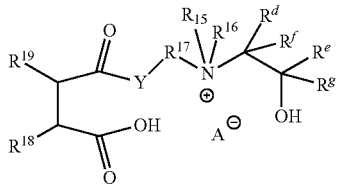

where $R^{15}$ to $R^{19}$, Y and $R^d$ to $R^g$, are as defined above, and A is a counter-ion derived from an acid, such as, for example, a carboxylic acid, such as acetic acid, glycolic acid, butanoic acid, salicylic acid, or mixtures thereof.

In some embodiments the quaternary compound can comprise, consist essentially of, or consist of a cation represented by the following formulas:

(XIV)

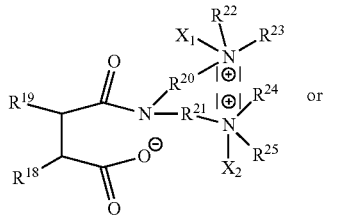

or (XV)

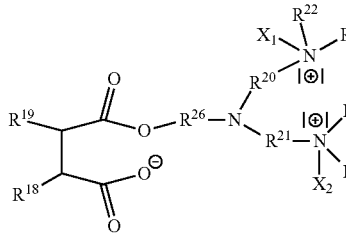

wherein: $R^{26}$ can be a C1 to C6 alkyl group; $R^{20}$ and $R^{21}$, individually, can be a C1 to C6 hydrocarbyl group, for example a C1, C2, or C3 alkyl group; $R^{22}$, $R^{23}$, $R^{24}$ and $R^{25}$, individual, can be hydrogen or a C1 to C6 hydrocarbyl group, such as, for example, a C1, C2, or C3 alkyl group; $R^{18}$ and $R^{19}$ are as described above; X1 and X2, individually, can be H or a group derived from a quaternizing agent.

In some embodiments the quaternary compound can comprise, consist essentially of, or consist of a coupled compound represented by the following formula:

(XVI)

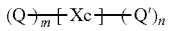

wherein: Q and Q' are the same or different and represent quaternizeable compounds, m and n are, individually, integers of between 1 and 4, and Xc represents a group derived from a coupling quaternizing agent, such as, for example, 1,4-butanediol diglycidyl ether, or bisphenol A diglycidyl ether. Example coupled quaternary ammonium compounds can include, for example, any of the formulas below:

(XVII)

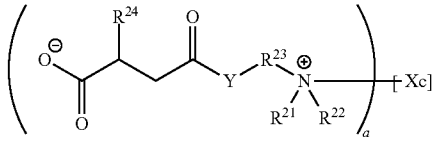

where a is an integer of from 2 to 8. An example of formula XVII where a is 2 or 3 can be represented, for example by formula XVII' and XVII", respectively;

(XVII′)

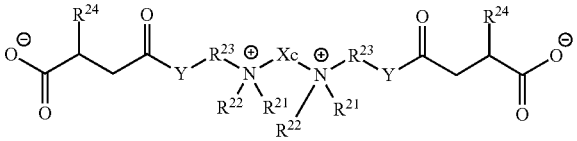

(XVII″)

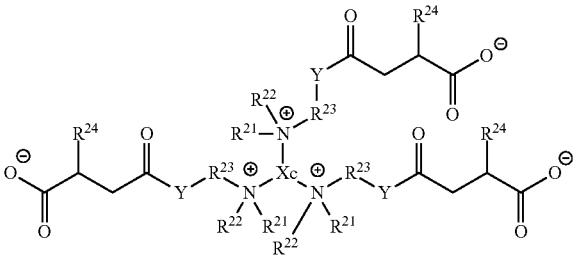

Further example coupled quaternary ammonium compounds can be, for example, as provided in formulas XVIII and XIX below:

(XVIII)

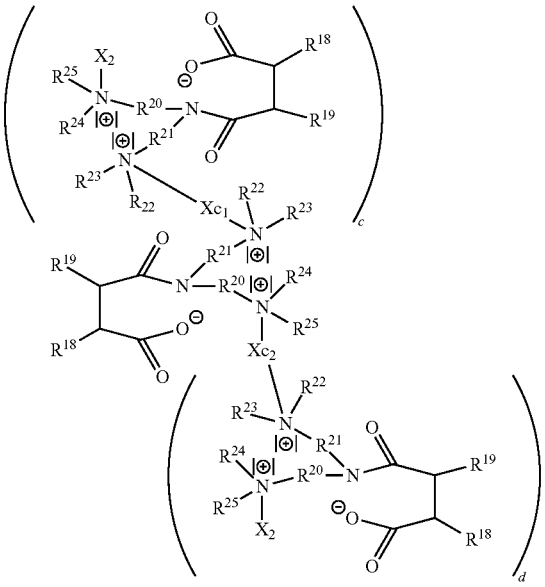

where c and d are, individually, 0 or 1;

(XIX)

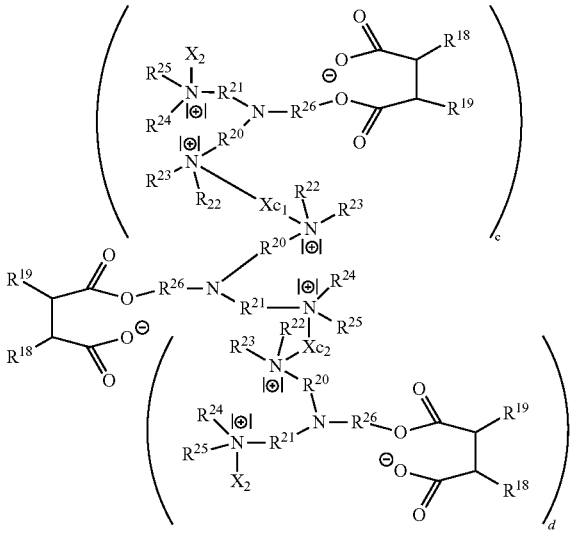

where c and d are, individually, 0 or 1, and where $R^{18}$ through $R^{24}$ and X1, X2, and Xc in each case are as defined above.

In some embodiments the quaternary compound can comprise, consist essentially of, or consist of a quaternary imide represented by the following formula:

(XX)

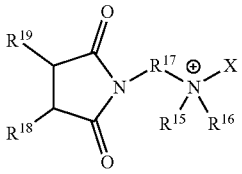

wherein: $R^{15}$ to $R^{19}$ are and X are as described above for formula (XI).

As with the quaternary amides and esters described above, X can be of formula

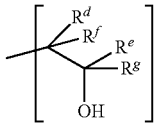

such as would be derived from a hydrocarbyl epoxide agent; where $R^d$, $R^e$, $R^f$, and $R^g$ separately can be H or a $C_1$ to $C_4$, or a $C_1$, $C_2$ or $C_3$ alkyl group, in which case formula (XX) would be, for example:

(XX')

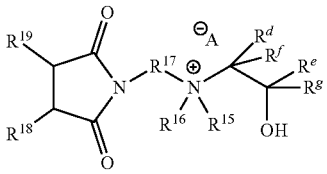

In some embodiments the quaternary compound can comprise, consist essentially of, or consist of a quaternary imide represented by the following formula:

(XXI)

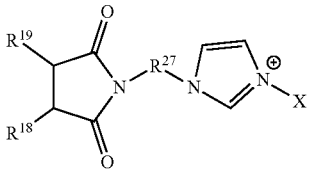

wherein: $R^{27}$ is a hydrocarbylene group containing from 1 to 20 carbon atoms; and $R^{18}$, $R^{19}$ and X are as defined above.

In some embodiments the quaternary compound can comprise, consist essentially of, or consist of a coupled quaternary ammonium compound represented by the following formula:

(XXII)

$$(Q)_m\text{—}Xc\text{—}(Q')_n$$

wherein: Q and Q' are the same or different and represent quaternizeable compounds, m and n are, individually, integers of between 1 and 4, and Xc represents a group derived from a coupling quaternizing agent, such as, for example, 1,4-butanediol diglycidyl ether, or bisphenol A diglycidyl ether. Example coupled quaternary ammonium compounds can include, for example, any of the formulas below:

(XXIII)

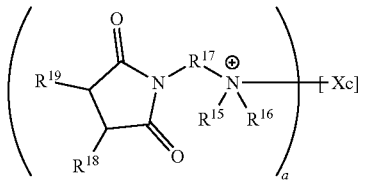

where a is an integer of from 2 to 8. An example of formula XXIII where a is 2 or 3 can be represented, for example by formula XXIII' and XXIII" respectively;

(XXIII')

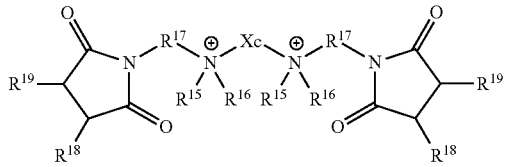

(XXIII")

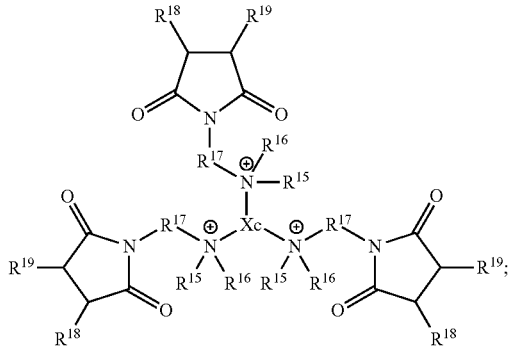

Even further example coupled quaternary ammonium compounds can be, for example, as provided in formulas XXIV below:

(XXIV)

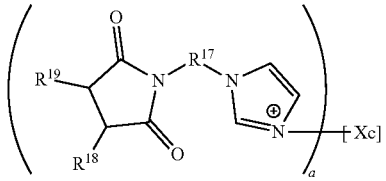

where a is an integer of from 2 to 8. An example of formula XXIV where a is 2 or 3 can be represented, for example by formula XXIV' and XXIV", respectively;

(XXIV')

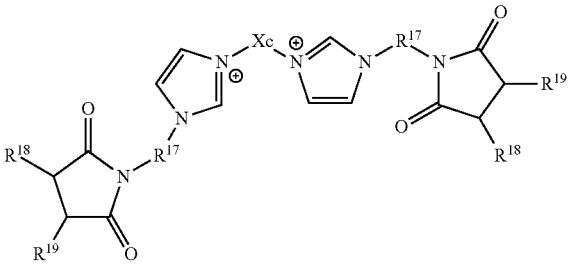

(XXIV")

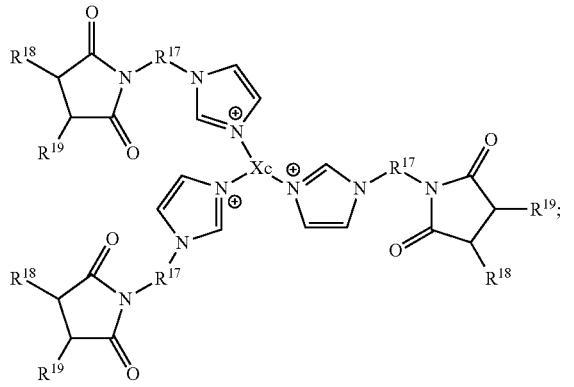

all wherein: $R^{17}$ through $R^{19}$ and Xc are as described above.

The process of preparing the anti-agglomerants may result in byproducts. In an embodiment, reference to anti-agglomerants encompasses such byproducts. In an embodiment, the anti-agglomerants are essentially free or even free of byproducts. Essentially free means less than about 5 wt %, or less than about 2.5 wt % or even less than 1 wt % or 0.5 wt %. Essentially free can also mean less than about 0.25 wt % or less than 0.1 or 0.05 wt %.

Anti-Agglomerant Formulations

The anti-agglomerant described above may be mixed with other additives to prepare an anti-agglomerant formulation. In particular, the anti-agglomerant may be combined with hydrocarbyl amido hydrocarbyl amines, acid scavengers, compatibilizers, and combinations thereof.

The hydrocarbyl amido hydrocarbyl amine, in some embodiments includes an alkylamido alkylamine, for example a cocamido alkylamine, or a alkylamido propylamine. In some embodiments the hydrocarbyl amido hydrocarbyl amine includes a cocamidopropyl dimethylamine.

In some embodiments the hydrocarbyl amido hydrocarbyl amine may include one or more compounds represented by the following formula:

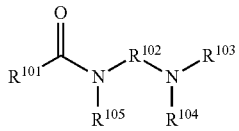

where $R^{101}$ is a hydrocarbyl group, $R^{102}$ is a divalent hydrocarbyl group, each $R^{103}$ and $R^{104}$ is independently hydrogen or a hydrocarbyl group, and $R^{105}$ is hydrogen or a hydrocarbyl group. $R^{101}$ may contain from 1 to 23 carbon atoms, 5 to 17 carbon atoms, or from 7 to 17, 9 to 17, 7 to 15, or even 9 to 13, or even about 11 carbon atoms. In some embodiments $R^{101}$ is at least 50%, on a molar basis, C11 (that is a hydrocarbyl group containing 11 carbon atoms). $R^{102}$ may contain from 1 to 10 carbon atoms, or from 1 to 4, 2 to 4, or even about 3 carbon atoms. $R^{103}$ may be hydrogen or may be a hydrocarbon group that contains from 1 to 23 carbon atoms, or from 1 to 18 carbon atoms, or from 1 to 16, 1 to 14, 1 to 12 carbon atoms, or even about 1 to 8 carbon atoms. $R^{104}$ may be hydrogen or may be a hydrocarbon group that contains from 1 to 23 carbon atoms, or from 1 to 18 carbon atoms, or from 1 to 16, 1 to 14, 1 to 12 carbon atoms, or even about 1 to 8 carbon atoms. In some embodiments both $R^{103}$ and $R^{104}$ are alkyl groups containing from 1 to 8 or 1 to 4 carbon atoms, and in some embodiments both $R^{103}$ and $R^{104}$ are methyl groups. $R^{105}$ may be hydrogen or may be a hydrocarbon group that contains from 1 to 23 carbon atoms, or from 1 to 18 carbon atoms, or from 1 to 16, 1 to 14, 1 to 12 carbon atoms, or even about 1 to 8 carbon atoms. In some embodiments $R^{105}$ is hydrogen. In still further embodiments both $R^{103}$ and $R^{104}$ are methyl groups and $R^{105}$ is hydrogen.

In some embodiments the hydrocarbyl amido hydrocarbyl amine may include one or more compounds represented by the following formula:

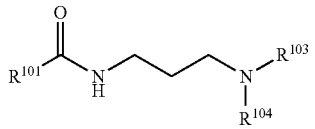

where $R^{101}$ is a hydrocarbyl group, each $R^{103}$ and $R^{104}$ is independently hydrogen or a hydrocarbyl group. $R^{101}$, $R^{103}$ and $R^{104}$ may each be defined as above.

The hydrocarbyl amido hydrocarbyl amine may include at least 50%, on a molar basis, of one or more of the hydrocarbyl amido hydrocarbyl amines described above, or even at least 60%, 70%, 80%, or even 90% of one or more of the hydrocarbyl amido hydrocarbyl amine described above. In some embodiments these percentages may be applied as weight percentages instead.

The hydrocarbyl amido hydrocarbyl amine can be derived from a vegetable oil, such as, for example, a coconut oil, a palm oil, a soybean oil, a rapeseed oil, a sunflower oil, a peanut oil, a cottonseed oil, an olive oil, and the like. The hydrocarbyl amido hydrocarbyl amine can also be fatty acid derivative of a vegetable oil. In some embodiments, the hydrocarbyl amido hydrocarbyl amine is derived from coconut oil. In some embodiments the hydrocarbyl amido hydrocarbyl amine is derived from fatty acids of coconut oil. In still further embodiments the hydrocarbyl amido hydrocarbyl amine includes cocamidopropyl dimethylamine. The hydrocarbyl amido hydrocarbyl amine may include at least 50%, on a molar basis, cocamidopropyl dimethylamine, or even at least 60%, 70%, 80%, or even 90% cocamidopropyl dimethylamine. In some embodiments these percentages may be applied as weight percentages instead.

In some embodiments the anti-agglomerant formulation can include a hydrocarbyl amido hydrocarbyl amine carried in a suitable solvent, such as, for example, water, an alcohol, and glycerin. In some cases, the hydrocarbyl amido hydrocarbyl amine can include a majority solvent, and in some cases the hydrocarbyl amido hydrocarbyl amine can include up to 50% by weight of a solvent. A solvent could be present with the hydrocarbyl amido hydrocarbyl amine on a weight basis of about 0.01 to about 50%, or 0.1 to about 40% or 0.5 to about 30%, or even from about 1.0 to about 25%. In some embodiments a solvent can be present at about 1.5 to about 20%, or 2.0 to about 15% or even 2.5 or 5 to about 10%.

In an embodiment the hydrocarbyl amido hydrocarbyl amine include cocamidopropyl dimethylamine and glycerin in a 50/50 weight ratio. In another embodiment the hydrocarbyl amido hydrocarbyl amine include about 60/40, or 70/30 or even 80/20 weight ratio of cocamidopropyl dimethylamine to glycerin. In an embodiment the hydrocarbyl amido hydrocarbyl amine includes about 90% by weight cocamidopropyl dimethylamine and about 10% by weight glycerin.

An example of an anti-agglomerant formulation may contain from about 10 to about 90 percent by weight of the anti-agglomerant described above and from about 90 to about 10 percent by weight of the described hydrocarbyl amido hydrocarbyl amines. Another example of an anti-agglomerant formulation may contain from about 40 to about 60 percent by weight of the anti-agglomerant described above and from about 20 to about 30 percent by weight of the described hydrocarbyl amido hydrocarbyl amines and about 20 to about 30 percent by weight of an alcohol such as methanol.

In some embodiments of the formulation of the anti-agglomerant and hydrocarbyl amido hydrocarbyl amine, the anti-agglomerant may not include the quaternizing agent. For example, the anti-agglomerant may simply be the reaction product of: (i) a dicarboxylic acid reactant, or a hydrocarbyl substituted dicarboxylic reactant (as described above), and (ii) a nitrogen containing compound having an oxygen or nitrogen atom capable of condensing with said dicarboxylic acid reactant (as described above). An example non-quaternized anti-agglomerant for use in a formulation with a hydrocarbyl amido hydrocarbyl amine can include the reaction product of a C1 to C22 alkane or olefin, such as polyisobutylene, substituted succinic anhydride reacted, for example, with an N,N-dialkyl-alkylene diamine, such as N,N-dimethyl-ethylene diamine. The nitrogen containing compound for the non-quaternized anti-agglomerant can also be an alkanol amine, such as, for example, an N,N-dialkyl-alkanol amine, for example, N,N-dimethyl-ethanol amine. Accordingly, the non-quaternized anti-agglomerant in the formulation with a hydrocarbyl amido hydrocarbyl amine can be an amide, imide, or ester.

The anti-agglomerant formulation can also contain an acid scavenger. Without being bound by theory, it is believed the presence of an acid scavenger interferes with any acids present in a crude hydrocarbon stream or an acid formed from the reaction of hydrogen sulfide or carbon dioxide and water present in the crude hydrocarbon stream, preventing the acid from interfering with the gas hydrate inhibitory effect of the hydrocarbyl amido hydrocarbyl amine or other gas hydrate inhibitor present in the formulation. Thus, acid-scavengers suitable for the anti-agglomerant formulation can be any basic compound capable of interfering with the specific types of acids present or formed in a particular crude hydrocarbon stream, which one of ordinary skill in the art could readily determine.

Examples of acid-scavengers useful in the anti-agglomerant formulation can include, for example, a basic compound, such as, an amine; an oxygen containing compound such as an oxide, an alkoxide, a hydroxide, a carbonate, a carboxylate, and metal salts of any of the foregoing oxygen containing compounds; and mixtures of any of the foregoing amines and oxygen containing compounds.

Amine acid-scavengers include hydrocarbyl substituted amines, and can be mono-amines as well as polyamines. The hydrocarbyl in a hydrocarbyl substituted amine can be straight chain or branched, saturated or unsaturated, generally containing from about 1 to about 12 carbon atoms, or 1 to 10 carbon atoms or 1 to 4 or 6 or 8 carbon atoms. Examples of amine acid-scavengers can include, for example, ammonia, methylamine, di- and tri-methylamine, propylamine, tributylamine, dimethylaminopropylamine, diethanolamine, diethylethanolamine, dimethylethanol amine, diethylenetriamine Triethyl enetetramine, Tetraethylenepentamine, and the like.

The oxygen containing compounds, i.e., the oxides, alkoxides, hydroxides, carbonates, and carboxylates can be in the form of a metal salt. The metal can be any metal, but particularly suitable metals can be alkali metals of group I in the periodic table (i.e., lithium, sodium, potassium, rubidium, caesium, francium) and alkaline earth metals of group II in the periodic table (i.e., beryllium, magnesium, calcium, strontium, barium, radium).

Suitable alkoxide acid scavengers can have an alkyl group of from about 1 to about 12 carbon atoms, or 1 to 10 carbon atoms or 1 to 4 or 6 or 8 carbon atoms and can be straight chain or branched, saturated or unsaturated. Example alkoxides include methoxides, ethoxides, isopropoxides, and tert-butoxides. Other example alkoxides can include sodium methoxide, sodium ethoxide, sodium propoxide, sodium butoxide, sodium pentoxide, potassium methoxide, potassium ethoxide, potassium propoxide, potassium butoxide, potassium pentoxide, magnesium methoxide, magnesium ethoxide, magnesium propoxide, magnesium butoxide, magnesium pentoxide, calcium methoxide, calcium ethoxide, calcium propoxide, calcium butoxide, and calcium pentoxide.

Example hydroxides can be sodium, potassium, magnesium, lithium and calcium hydroxide. Similarly, example oxides can include sodium, potassium, magnesium and calcium oxide.

The acid scavengers can be included in anti-agglomerant formulations along with the anti-agglomerant commensurate with the level of acid contained in the crude hydrocarbon stream being treated. That is, a sufficient amount of acid scavenger can be added in the formulation to achieve a pH in the crude hydrocarbon stream of about 7 or greater, or about 8 or greater, or about 9 or greater. In some embodiments, the anti-agglomerant formulations can contain the anti-agglomerant described above and from about 0.01 to about 20 wt % of an acid scavenger, or from 0.01 to about 10 wt %, or from about 0.05 to about 5 wt %, or from about 0.1 to about 3 or 4 wt %. In some embodiments the acid scavenger can be present in the anti-agglomerant formulations from about 0.1 to about 2 wt %, or from about 0.2 to about 1.5 wt % or about 0.4 to about 1.0 wt %. In some embodiments the acid scavenger can be present in the anti-agglomerant formulations from about 1.0 to about 6 wt %, or from about 1.5 to about 5 wt % or about 2 to about 4 wt %.

Another example of an anti-agglomerant formulation may contain from about 40 to about 60 percent by weight of the anti-agglomerant described above and from about 20 to about 30 percent by weight of the described hydrocarbyl amido hydrocarbyl amines and about 0.01 to about 20 percent by weight of an acid scavenger, such as, for example, tri-butyl amine.

Compatibilizers suitable for the anti-agglomerant formulation can include any compatibilizer capable of assisting the compatibility in a crude hydrocarbon stream, such as, for example, a natural gas or crude petroleum stream, of the anti-agglomerant described herein, and/or any hydrocarbyl amido hydrocarbyl amine present. Examples of suitable compatibilizers useful in the anti-agglomerant formulation can be, for example, straight chain or branched alkyls of from about 5 to about 12 carbon atoms. Such examples can include n-octane, hexane, heptane, nonane, decane, and the like. The anti-agglomerant additive may also include other hydrate inhibitors. Non-limiting examples of such hydrate inhibitors include thermodynamic inhibitors (including, but not limited to, methanol, ethanol, n-propanol, isopropanol, ethylene glycol, propylene glycol), kinetic inhibitors (including, but not limited to homopolymers or copolymers of vinylpyrrolidone, vinylcaprolactam, vinylpyridine, vinylformamide, N-vinyl-N-methylacetamide, acrylamide, methacrylamide, ethacrylamide, N-methylacrylamide, N,N-dimethylacrylamide, N-ethylacrylamide, N-isopropylacrylamide, N-butylacrylamide, N-t-butylacrylamide, N-octylacrylamide, N-t-octylacrylamide, N-octadecylacrylamide, N-phenylacrylamide, N-methylmethacrylamide, N-ethylmethacrylamide, N-isopropylmethacrylamide, N-dodecylmethacrylamide, 1-vinylimidazole, and 1-vinyl-2-methylvinylimidazole) and anti-agglomerants (including, but not limited to, tetralkylammonium salts, tetraalkylphosphonium salts, trialkyl acyloxylalkyl ammonium salts, dialkyl diacyloxyalkyl ammonium salts, alkoxylated diamines, trialkyl alkyloxyalkyl ammonium salts, and trialkyl alkylpolyalkoxyalkyl ammonium salts).

Additional inhibitors that may be used in combination with the anti-agglomerant additive formulation include those described in U.S. Pat. No. 7,452,848.

In some embodiments the anti-agglomerant formulation can additionally comprise a suitable solvent, such as, for example, water, an alcohol, such as ethylene glycol, and glycerin.

Other suitable solvents for making formulations containing the anti-agglomerant can include the aforementioned thermodynamic inhibitors as well as water, alcohols containing 4 to 6 carbon atoms, glycols containing 4 to 6 carbon atoms, ethers containing 4 to 10 carbon atoms, mono-alkyl ethers of glycols containing 2 to 6 carbon atoms, esters containing 3 to 10 carbon atoms, and ketones containing 3 to 10 carbon atoms.

The anti-agglomerant formulation can be diluted in about 70 to about 90 percent by weight of an alcohol such as methanol. In another example, the anti-agglomerant additive formulation can be diluted in a mixture of about 10 to 30 percent by weight of a polymeric kinetic inhibitor, 20 to 40 percent by weight water, and 20 to 40 percent by weight of 2-butoxyethanol.

Other additives that may be admixed with the anti-agglomerants can include, but are not limited to, corrosion inhibitors, wax inhibitors, scale inhibitors, asphaltene inhibitors, demulsifiers, defoamers, and biocides. The amount of anti-agglomerants in such a mixture can be varied over a range of 1 to 100 percent by weight or even 5 to 50 percent by weight.

Also included in the present technology are compositions made up of a crude hydrocarbon stream, and an anti-agglomerant as described herein. Such compositions can also include water. Such compositions describe what one would expect to find inside, for example, a crude natural gas stream and/or crude petroleum stream pipeline and/or in equipment used to handle and process crude natural gas streams and/or crude petroleum streams.

As used herein, the term "crude hydrocarbon stream" refers to an unrefined product from a natural hydrocarbon producing well, such as, for example, a methane product, a natural gas product, a crude petroleum oil product, or any mixtures thereof. In one embodiment, the crude hydrocarbon stream can comprise, consist of, or consist essentially of methane. In another embodiment, the crude hydrocarbon stream can comprise, consist of, or consist essentially of natural gas. In an embodiment, the crude hydrocarbon stream can comprise, consist of, or consist essentially of a condensate. As used herein the term condensate refers to a low-density mixture of hydrocarbon liquids that are present as gaseous components in a raw natural gas and that condenses out of the raw gas if the temperature is reduced to below the hydrocarbon dew point temperature of the raw gas. In a further embodiment, the crude hydrocarbon stream can comprise, consist of, or consist essentially of crude petroleum. In a still further embodiment, the crude hydrocarbon stream can comprise, consist of, or consist essentially of a mixture of natural gas and crude petroleum, or it can comprise, consist of, or consist essentially of a mixture of methane and crude petroleum. The crude hydrocarbon stream can be heavy on gas, meaning the stream comprises more gaseous hydrocarbons than liquid hydrocarbons, or it can be heavy on oils, meaning the stream comprises more liquid hydrocarbons than gaseous hydrocarbons. In one embodiment, the crude hydrocarbon stream can comprise, consist of, or consist essentially of gaseous hydrocarbons. In another embodiment the crude hydrocarbon stream can comprise, consist of, or consist essentially of liquid hydrocarbons. These hydrocarbon streams can additionally comprise one or more lower hydrocarbons or other hydrate forming compound, or in some cases, two or more lower hydrocarbons or other hydrate forming compound.

Modification of crystalline hydrate formation may for example slow, reduce, or eliminate nucleation, growth, and/or agglomeration of hydrates. As used herein, the term "hydrate" can include gas hydrates and/or ice crystals. The term "gas hydrates" means a crystalline hydrate of a lower hydrocarbon or other hydrate forming compound. The term "lower hydrocarbon" means any of methane, ethane, propane, any isomer of butane, and any isomer of pentane. Other hydrate forming compounds can include, for example, carbon dioxide, hydrogen sulfide and nitrogen. "Type I gas hydrates" refer to gas hydrates formed in the presence of mainly one lower hydrocarbon selected from only one of methane, ethane or carbon dioxide. Mainly defined as greater than 95%. "Type II gas hydrates" refer to gas hydrates formed in the presence of two or more different lower hydrocarbons or other hydrate forming compound.

In one embodiment the composition can be made up of water, a crude hydrocarbon stream containing two or more lower hydrocarbons or other hydrate forming compound, and the anti-agglomerant. In one embodiment the composition can be made up of water, a crude natural gas stream containing two or more lower hydrocarbons or other hydrate forming compound, and the anti-agglomerant, and in another embodiment the composition can be made up of water, a crude petroleum stream containing two or more lower hydrocarbons or other hydrate forming compound, and the anti-agglomerant. In the foregoing embodiments, the two or more lower hydrocarbons or other hydrate forming compound can include any combination of lower hydrocarbons or other hydrate forming compound, such as, for example, methane and one or more of ethane, propane, any isomer of butane, any isomer of pentane, carbon dioxide, hydrogen sulfide, nitrogen, and combinations thereof.

In another embodiment the composition can be made up of water, a crude hydrocarbon stream containing one or two or more lower hydrocarbons or other hydrate forming compound, and an above described anti-agglomerant additive formulation (i.e., a quaternary ammonium salt of a reaction product of a dicarboxylic acid and a nitrogen containing compound). In an embodiment the composition can be made up of water, a methane stream containing one or more lower hydrocarbons or other hydrate forming compound, and an above described anti-agglomerant additive formulation. In one embodiment the composition can be made up of water, a crude natural gas stream containing one or two or more lower hydrocarbons or other hydrate forming compound, and an above described anti-agglomerant additive formulation, and in another embodiment the composition can be made up of water, a crude petroleum stream containing one or two or more lower hydrocarbons or other hydrate forming compound, and an above described anti-agglomerant additive formulation. In the foregoing embodiments, the one or more lower hydrocarbons or other hydrate forming compound can include any combination of lower hydrocarbons or other hydrate forming compound, such as, for example, methane, ethane, propane, any isomer of butane, any isomer of pentane, carbon dioxide, hydrogen sulfide, nitrogen, and combinations thereof.

The water content of such compositions may vary greatly. One benefit of the inhibitor of the present technology is that those described can be effective anti-agglomerates even at relatively high water contents where other additives may no longer be effective. Thus the described anti-agglomerate inhibitors can be more effective anti-agglomerates that provide performance in a wider range of compositions and operating conditions, including those that see high water contents.

In some embodiments the compositions described herein contain at least 30%, by weight, water, or even at least 20%, 30%, 40%, 50%, 60%, 70%, 80% or even 90%, 95% or even 99% by weight water. In some embodiments the composition may be described as having a water cut, where the water cut refers to the amount of aqueous phase present relative to the total liquids present, ignoring any gaseous phase and where the described anti-agglomerant is considered part of the water phase. Such water cuts in the described compositions may be any of the percentages noted above, and in some embodiments is from 30% to about 100% by weight, where the 100% means that essentially no oil phase is present, which may also be described as a wet gas situation (i.e. a gas pipeline containing some amount of water but no oil component). The anti-agglomerant used in these compositions may be any one or more of the anti-agglomerant additive or anti-agglomerant additive formulations described above.

In some embodiments the described compositions also contain some amount of gas hydrates, where at least a portion of the water and at least a portion of the one or two or more lower hydrocarbons or other hydrate forming compound, present in the crude hydrocarbon stream, are in the form of one or two or more gas hydrates.

Methods

Another aspect of the present technology is directed to a method of inhibiting the agglomeration of gas hydrates, where the method includes contacting a crude hydrocarbon stream, itself made up of water and one or more lower hydrocarbons or other hydrate forming compounds, with at least one anti-agglomerant capable of preventing or inhibiting agglomeration of the gas hydrates. In one embodiment the method includes contacting a crude hydrocarbon stream comprising water and one or more lower hydrocarbons or other hydrate forming compound with at least one above described anti-agglomerant, such as an anti-agglomerant additive or an anti-agglomerant additive formulation. In another embodiment the method includes contacting a crude natural gas stream or crude petroleum stream comprising water and two or more lower hydrocarbons or other hydrate forming compound with at least one anti-agglomerate, such as an anti-agglomerant additive or an anti-agglomerant additive formulation.

The foregoing methods may be employed in the capture of a crude hydrocarbon stream from a well, and/or in a flow line carrying the hydrocarbon stream.

The anti-agglomerants can provide protection against the agglomeration of gas hydrates either on their own, or in any desired mixture with one another or with other anti-agglomerant additive formulations or anti-agglomerant additives known in the art, or with solvents or other additives included for purposes other than anti-agglomeration.

Useful mixtures can be obtained by admixing before introduction to potential hydrate-forming fluids, or by simultaneous or sequential introduction to potential hydrate-forming fluids.

It will be appreciated that it is very difficult, if not impossible, to predict in advance the dosages or proportions of components that will be effective in inhibiting agglomeration in a given application. There are a number of complex, interrelated factors that must be taken into account, including, but not limited to, the salinity of the water, the composition of the hydrocarbon stream, the relative amounts of water and hydrocarbon, and the temperature and pressure. For these reasons, dosages and proportions of components are generally optimized through laboratory and field testing for a given application, using techniques well known to those of ordinary skill in the art.

The anti-agglomerants may be added to a composition comprising water and one or more lower hydrocarbons or other hydrate forming compounds, where the anti-agglomerant is added in an amount that is effective to reduce or modify the agglomeration of gas hydrates in the overall composition. The anti-agglomerants may be added to a composition containing a lower hydrocarbon or other hydrate forming compound before water is added, or vice versa, or it may be added to a composition already containing both. The addition may be performed before the composition is subjected to elevated pressures or to reduced temperatures, or after.

An example hydrocarbon composition can contain about 0.05 to about 6.0 or 8.0 percent by weight of the described anti-agglomerants based on the content of water in the hydrocarbon composition (e.g., a crude hydrocarbon stream), or from about 0.1 to about 5 wt %, or from about 0.5 to about 2.5 wt % based on the content of water.

Compositions that can be treated in accordance with the present technology include fluids comprising water and molecules of lower hydrocarbons or other hydrate forming compound, in which the water and molecules of lower hydrocarbons or other hydrate forming compound together can form clathrate hydrates. The fluid mixtures may comprise any or all of a gaseous water or organic phase, an aqueous liquid phase, and an organic liquid phase, in any proportion. The fluids may also contain acidic species, such as carbon dioxide, hydrogen sulfide, and combinations thereof. Typical fluids to be treated include crude petroleum or crude natural gas streams, for example those issuing from an oil or gas well, particularly a sub-sea oil or gas well where the high pressures and low temperatures may be conducive to gas hydrate formation.

The anti-agglomerants may be added to the fluid mixture in a variety of ways, the lone requirement being that the selected anti-agglomerant be sufficiently incorporated into the fluid mixture to control the hydrate formation. For example, the selected anti-agglomerant may be mixed into the fluid system, such as into a flowing fluid stream. Thus, the anti-agglomerant may be injected into a downhole location in a producing well to control hydrate formation in fluids being produced through the well. Likewise, the anti-agglomerant may be injected into the produced fluid stream at a wellhead location, or even into piping extending through a riser, through which produced fluids are transported in offshore producing operations from the ocean floor to the offshore producing facility located at or above the surface of the water. Additionally, the anti-agglomerant may be injected into a fluid mixture prior to transporting the mixture, for example via a subsea pipeline from an offshore producing location to an onshore gathering and/or processing facility.

Incorporating or mixing the anti-agglomerant into the fluid mixture may be aided by mechanical means well known in the art, including for example the use of a static in-line mixer in a pipeline. In most pipeline transportation applications, however, sufficient mixture and contacting will occur due to the turbulent nature of the fluid flow, and mechanical mixing aids are not necessary.

The water employed in the composition can be in the form of a brine, containing an amount of a salt. Example salts can be sodium chloride, potassium chloride, and magnesium chloride, or combinations thereof. The salt content of any such brine can be from about 0.1 to about 10% by weight, or from about 0.5 to about 5% by weight, or even 1 to about 1.5 or 2.5% by weight based on the total content of water.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, in some embodiments no more than one, non-hydrocarbon substituent will be present for every ten carbon atoms in the hydrocarbyl group; typically, there will be no non-hydrocarbon substituents in the hydrocarbyl group. As used herein, the term "hydrocarbonyl group" or "hydrocarbonyl substituent" means a hydrocarbyl group containing a carbonyl group.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

It is known that some of the materials described above may interact with one another during their use, so that the components of the final formulation may be different from those that are initially added. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples. While the Examples are provided to illustrate the invention, they are not intended to limit it.

Sample 1—Reaction product of a dodecenyl succinic anhydride ("DDSA") with dimethylaminopropylamine ("DMAPA"), and then further reacted with propylene oxide in the presence of acetic acid. The predominant structure of the chemistry obtained is:

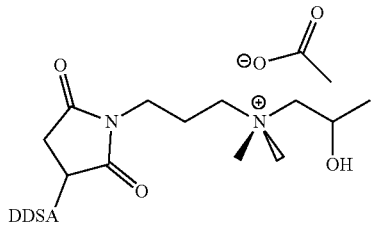

Sample 2—Reaction product of hexadecenyl succinic anhydride ("HDSA") and DMAPA, and then further reacted with propylene oxide in the presence of acetic acid. The predominant structure of the chemistry obtained is:

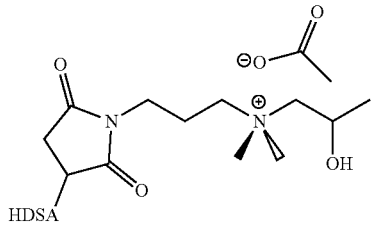

Sample 3—Reaction product of HDSA and dimethylaminopropanol, and then further reacted with propylene oxide in the presence of water. The predominant structure of the chemistry obtained is:

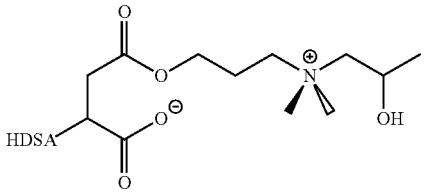

Sample 4—Reaction product of HDSA and DMAPA, and then further reacted with propylene oxide in the presence of water. The predominant structure of the chemistry obtained is:

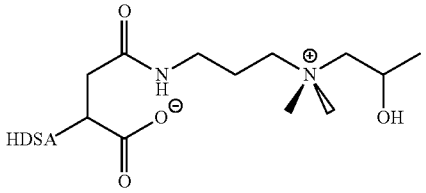

Sample 5—Reaction product of a 550 number average molecular weight, as calculated from the Total Acid Number measured, polyisobutylene succinic anhydride and DMAPA, and then further reacted with propylene oxide in the presence of acetic acid and water. The foregoing reaction provides a mixture containing mostly:

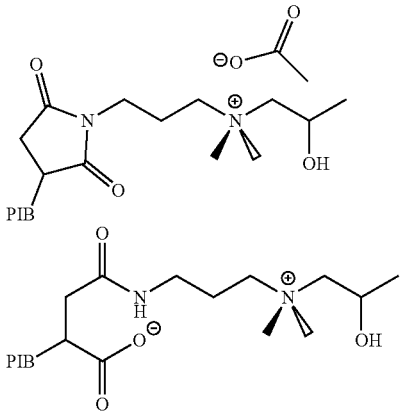

Sample 6—Reaction product of a $C_{14}$ to $C_{18}$ olefin substituted succinic anhydride and an N,N-dimethyl-ethanol amine.

Sample 7—Reaction product of coconut oil with DMAPA. The predominant structure of the chemistry obtained is:

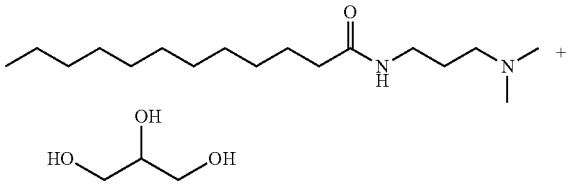

Two test methods were utilized to evaluate the performance of the above samples as gas hydrate anti-agglomerant; 1) stirred high pressure autoclave, and 2) sapphire rocking cell apparatus. The Hydrate anti-agglomerant formulations tested and the different gas mixes are detailed in Table 1 and Table 2.

TABLE 1

Hydrate anti-agglomerant formulations - by % Wt.

| Formulation | A | B | C | D | E | F |
|---|---|---|---|---|---|---|
| Sample 6 | 50 | | | | | |
| Sample 1 | | 50 | | | | |
| Sample 2 | | | 50 | | | |
| Sample 3 | | | | 50 | | |
| Sample 4 | | | | | 50 | |
| Sample 5 | | | | | | 50 |
| Sample 7 | 25 | 25 | 25 | 25 | 25 | 25 |
| Methanol | 25 | 25 | 25 | 25 | 25 | 25 |

The gas mixtures used are shown in Table 2

TABLE 2

Description of gas mixes used in experiments. By Wt. %

| Gas Mix | Butane | Ethane | Isobutane | Isopentane | Nitrogen | N-Pentane | Propane | Carbon dioxide | Methane |
|---|---|---|---|---|---|---|---|---|---|
| GOM | 0.79 | 7.36 | 0.49 | 0.20 | 0.38 | 0.20 | 3.1 | 0 | Balance |
| NS | 1.74 | 10.84 | 0.62 | 0.20 | 1.75 | 0.19 | 4.63 | 1.36 | Balance |
| Sweet | 1 | 12.5 | 0 | 0 | 1.3 | 0 | 3 | 3 | Balance |
| Methane | 0 | 0 | 0 | 0 | 0 | 0 | 0 | 0 | 100 |

GOM = Gulf of Mexico [Green Canyon].
NS = North Sea.
Sweet = Sweet gas mix

Stirred Autoclave Testing

The experiments were performed using a PSL Systemtechnik Gas Hydrate Autoclave (GHA 350) system, which comprised an autoclave with sapphire glass window; pressure transducer and temperature probe (controlled by a chiller); stirrer and torque sensor; boroscope and camera system. Gasses are controlled by the control panel and booster pump.

The autoclave was initially purged with N2 gas (3×60 PSI) at 20° C. while stirring at 150 rpm. The test gas mix (Table 2) was then charged to the autoclave containing 200 mL of test fluid to the selected pressure (psi). Having equilibrated at 20° C. for 1 hour, the autoclave temperature was decreased to 4° C. over 3 hours (5.3° C./hr). After 1 hour stirring at 4° C. at 250 rpm, stirring was stopped in order to simulate a shut-in for 9 hours. After this time the stirring was restarted for a further 1 hour at 4° C., followed by another 1 hour at 20° C. The contents of the autoclave were then warmed to above room temperature (25° C.) to dissolve hydrates formed.

Torque measurements were used to study the effect of the anti-agglomerant formulations on hydrate agglomeration and plugging. When hydrates are formed there was an increase in the viscosity of the fluid (coinciding with a drop in pressure) and hence resistance to the rotating force of the stirrer. This translated into an increase in torque. The maximum torque was the point of highest potential for hydrate agglomeration or blockage. An effective anti-agglomerant eliminates or reduces this increase in torque, compared to baseline (untreated) measurements.

The test fluid comprised an oil phase (either a crude oil or condensate (Drillsol Plus) and aqueous phase (tap water or 3% NaCl brine). The proportion of oil and water is described as the water-cut (% water present). Anti-agglomerant dosage is based on the water-cut.

Table 3 shows the torque measurements for the formulations in brine/condensate, dosed at 1 wt % in GOM gas at an initial pressure of 1700 psi.

TABLE 3

Autoclave test data; torque Measurements:
Aq phase = 3% NaCl brine, Oil phase = condensate
(Drillsol Plus) (water-cut = 30%).

| | Maximum Torque Observed (Ncm) | | | % Torque |
|---|---|---|---|---|
| AA | Before Shutdown | After Shutdown | Max Torque | Reduction |
| Control | 24 | 24 | 24 | — |
| A | 21 | 8 | 21 | 13 |
| B | 13 | 13 | 13 | 46 |
| C | 30 | 12 | 30 | −25 |
| C | 24 | 15 | 24 | 0 |
| D | 10 | 13 | 13 | 46 |
| E | 88 | 89 | 89 | −271 |

TABLE 3-continued

Autoclave test data; torque Measurements:
Aq phase = 3% NaCl brine, Oil phase = condensate
(Drillsol Plus) (water-cut = 30%).

| | Maximum Torque Observed (Ncm) | | | % Torque |
|---|---|---|---|---|
| AA | Before Shutdown | After Shutdown | Max Torque | Reduction |
| E | 85 | 86 | 86 | −258 |
| F | 9 | 6 | 9 | 63 |

Formulation "F" (containing Sample 5 and Sample 7 in methanol) significantly reduced the max torque compared to the baseline run. Formulation "B" (containing Sample 1 and Sample 7 in methanol) and formulation D (containing Sample 3 and Sample 7 in methanol) were also shown to be effective.

Table 4 shows the torque measurements for the formulations in brine/crude oil, dosed at 1 wt % in GOM gas at an initial pressure of 1700 psi.

TABLE 4

Autoclave test data; torque Measurements:
Aq phase = 3% NaCl brine, Oil phase = crude oil
(water-cut = 30%).

| | Maximum Torque Observed (Ncm) | | | |
|---|---|---|---|---|
| AA | Before Shutdown | After Shutdown | Max Torque | % Torque Reduction |
| Control | 9 | 29 | 29 | — |
| A | 20 | 15 | 20 | 31 |
| B | 6 | 5 | 6 | 79 |

TABLE 4-continued

| Autoclave test data; torque Measurements: Aq phase = 3% NaCl brine, Oil phase = crude oil (water-cut = 30%). | | | | |
|---|---|---|---|---|
| | Maximum Torque Observed (Ncm) | | | |
| AA | Before Shutdown | After Shutdown | Max Torque | % Torque Reduction |
| D | 12 | 11 | 12 | 59 |
| F | 7 | 11 | 11 | 62 |

Formulations "F," "B," and "D" significantly reduced the max torque compared to the baseline run.

Table 5 shows the torque measurements for the components (Samples 1-7) in brine/condensate, dosed at 0.75 wt % in GOM gas at an initial pressure of 1700 psi.

TABLE 5

| Autoclave test data; torque Measurements: Aq phase = 3% NaCl brine, Oil phase = condensate (Drillsol Plus) (water-cut = 30%). | | | | |
|---|---|---|---|---|
| | Maximum Torque Observed (Ncm) | | | % |
| AA | Before Shutdown | After Shutdown | Max Torque | Torque Reduction |
| Control | 24 | 24 | 24 | — |
| Sample 6 | 8 | 7 | 8 | 67 |
| Sample 1 | 104 | 93 | 104 | −333 |
| Sample 2 | 10 | 11 | 11 | 54 |
| Sample 3 | 17 | 15 | 17 | 29 |
| Sample 4 | 107 | 106 | 107 | −346 |
| Sample 5 | 16 | 2 | 16 | 33 |
| Sample 7 | 15 | 10 | 15 | 38 |

Sample 5 significantly reduced the max torque compared to the baseline run. As did Sample 2 and Sample 3.

Rocking Cell Testing

Experiments were performed using a sapphire rocking cell apparatus. Each cell has a volume of 20 mL, equipped with a magnetic stir-bar to aid agitation. The cells were charged with 10 mL liquid samples. The aqueous phase is either distilled (DI) water or brine (3% NaCl in water), the oil phase either a crude oil or kerosene. The proportion of oil and water is described as the water-cut (% water present). Anti-agglomerant dosage is based on the water-cut.

The water bath is filled before the cells are pressurized with a test gas (Table 1) to the desired pressure. The rocking frequency is set to 15 times/min. The bath temperature, the pressure and stir bar movement during rocking are recorded. After charging the cells with a test sample, they are rocked at around 24° C. for 30 min to reach equilibrium. At this point the test is run at either constant pressure by continually adding gas to the cell throughout the test to replace gases removed to hydrate formation, or constant volume where no further gas is added to the cell (cell pressure drops on hydrate formation).

Once pressurized and equilibrated the water bath is cooled from the initial temperature to 4° C. at different rates varying from −5.3° C./hr to −8° C./hr, while the cells are being rocked. They are then kept at 4° C. for a period of time allowing the gas hydrates to fully develop before the temperature ramps back to the initial temperature.

TABLE 6

| Rocking cell data at constant Pressure: Aq phase = 3% NaCl brine, Oil phase = crude oil, Gas = GOM (water-cut = 40%) Profile at 4° C.: 4 hr rocking, 16 hr shut-in, restart for 2 hr. | | | | |
|---|---|---|---|---|
| Sample | Hydrate Formation T | Plug T | Plug time | Comments |
| A | 9.8 | — | — | Milky, opaque emulsion. A mobile, well dispersed slurry develops on cool-down (P drop). Hydrate silt settles out during shut-in. Slurry imobile on first rock after shut-in but soon redisperses and is mobile. |
| F | | | | One Pass. One Fail. Details to follow |
| F | 10.8 | 9.3 | — | Two phases (clear/milky). Hydrate crystals appear on cooldown (P drop). Large agglomerations rapidly form in aq layer, especially around the stirrer. Agglomerations develop throughout the bulk, reduction in liquid volume and the stirrer bar becomes stuck. |

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Except where otherwise indicated, all numerical quantities in the description specifying amounts or ratios of materials are on a weight basis. Unless otherwise indicated, each chemical or composition referred to herein should be interpreted as being a commercial grade material which may contain the isomers, byproducts, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration.

As used herein, the term "about" means that a value of a given quantity is within ±20% of the stated value. In other embodiments, the value is within ±15% of the stated value. In other embodiments, the value is within ±10% of the stated value. In other embodiments, the value is within ±5% of the stated value. In other embodiments, the value is within ±2.5% of the stated value. In other embodiments, the value is within ±1% of the stated value.

Additionally, as used herein, the term "substantially" means that a value of a given quantity is within ±10% of the stated value. In other embodiments, the value is within ±5% of the stated value. In other embodiments, the value is within ±2.5% of the stated value. In other embodiments, the value is within ±1% of the stated value.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. An anti-agglomerate additive formulation comprising A) an anti-agglomerate that is the reaction product of: (i) a dicarboxylic acid reactant substituted with a hydrocarbyl group chosen from methane, butane, or butene, hexane or hexene, nonane or nonene, dodecane or dodecene, octadecane or octadecene, eicosane, or eicosene, docosane or docosene and branched derivatives and isomers thereof, and polyolefins, (ii) a nitrogen containing compound having an oxygen or nitrogen atom capable of condensing with said hydrocarbyl substituted dicarboxylic acid reactant, and further having at least one quaternizeable amino group, and (iii) a quaternizing agent suitable for converting the quaternizeable amino group of the nitrogen containing compound to a quaternary nitrogen selected from sulphonates; sultones; phosphates; borates; nitrites; nitrates; oxalates; alkanoates; dithiophosphates; sulfates; halides; carbonates; hydrocarbyl epoxides; carboxylates; esters; and mixtures thereof, and B) a hydrocarbyl amido hydrocarbyl amine of formula:

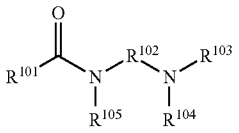

where $R^{101}$ is a hydrocarbyl group of 1 to 23 carbon atoms, $R^{102}$ is a divalent hydrocarbyl group of 1 to 10 carbon atoms, each $R^{103}$ and $R^{104}$ is independently hydrogen or a hydrocarbyl group of 1 to 23 carbon atoms, and $R^{105}$ is hydrogen or a hydrocarbyl group of 1 to 23 carbon atoms.

2. The anti-agglomerate additive of claim 1, wherein the dicarboxylic acid reactant is a polyisobutylene succinic anhydride, wherein the polyisobutylene substituent has a number average molecular weight of about 100 to about 1000.

3. The anti-agglomerate additive of claim 1, wherein the dicarboxylic acid reactant comprises a hydrocarbyl substituent having a $C_1$ to $C_{22}$ alkane or olefin substituted succinic anhydride.

4. The anti-agglomerate additive of claim 1, wherein the quaternizable amino group of the nitrogen containing compound is a primary, secondary or tertiary amino group.

5. The anti-agglomerate additive formulation of claim 1 wherein the nitrogen containing compound is an N,N-dialkyl-alkylene diamine.

6. The anti-agglomerate additive of claim 1, wherein the nitrogen containing compound comprises an alkanolamine.

7. The anti-agglomerate additive formulation of claim 6 wherein the alkanolamine is an N,N-dialkyl-alkanol amine.

8. The anti-agglomerate additive of claim 1, wherein the quaternizing agent is a hydrocarbyl epoxide.

9. The anti-agglomerate additive formulation of claim 1, wherein the quaternizing agent is employed in combination with an acid.

10. The anti-agglomerate additive formulation of claim 9, wherein the acid is a carboxylic acid.

11. The anti-agglomerate additive formulation of claim 1, wherein the reaction product of (A)(i) and (A)(ii) comprises at least one of an amide, imide, or ester.

12. The anti-agglomerate additive of claim 1, wherein the reaction product of (A) comprises a compound of at least one of formulas:

(XI')

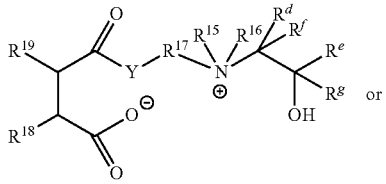

or (XII)

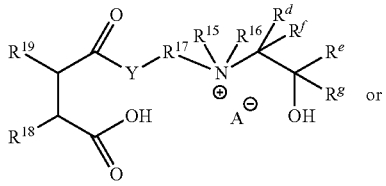

or (XX')

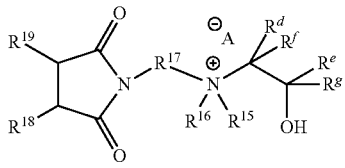

wherein $R^{15}$ and $R^{16}$ are, independently, alkyl groups containing from 1 to 18 carbon atoms;

$R^{17}$ is a hydrocarbyl group containing from 1 to 12 carbon atoms and up to 3 nitrogen atoms;

$R^{18}$ is H, an alkyl or olefin group of 1 to 22 carbon atoms, or a hydrocarbyl group having a number average molecular weight of from about 100 to about 1000;

$R^{19}$ is H, an alkyl or olefin group of 1 to 22 carbon atoms, or a hydrocarbyl group having a number average molecular weight of from about 100 to about 1000;

A is a counter-ion derived from an acid;

$R^d$, $R^e$, $R^f$, and $R^g$ separately are H or a $C_1$ to $C_4$ alkyl group; and Y is O or NV, wherein $R^{28}$ is H or a hydrocarbyl group of 1 to 18 carbon atoms.

13. An anti-agglomerate composition comprising a crude hydrocarbon stream and an additive capable of modifying gas hydrate formation comprising the anti-agglomerate additive of claim 1.

14. The anti-agglomerate composition of claim 13, further comprising one or more lower hydrocarbons or other hydrate forming compounds.

15. The composition according to claim 13, wherein at least a portion of the water and at least a portion of the one or more lower hydrocarbons or other hydrate forming compounds is in the form of one or more gas hydrates.

16. The composition of claim 13, wherein the crude hydrocarbon stream is a stream from a methane well, a natural gas well, or a petroleum well.

17. The composition according to claim 13, wherein the crude hydrocarbon stream comprises one or more other hydrate forming compounds comprising carbon dioxide, hydrogen sulfide, or a combination thereof.

18. The anti-agglomerate composition of claim 1, further comprising water.

19. A method of preventing agglomeration of hydrates, the method comprising contacting a crude hydrocarbon stream with at least one anti-agglomerate additive as claimed in claim 1.

20. The method of claim 19, wherein the crude hydrocarbon stream further comprises water.

21. The method of claim 19, wherein the crude hydrocarbon stream further comprises one or more lower hydrocarbons or other hydrate forming compounds.

22. The method of claim 19, wherein the crude hydrocarbon stream is a stream from a methane well, a natural gas well or a petroleum well.

* * * * *